US007694499B2

(12) United States Patent
Ballestrazzi et al.

(10) Patent No.: US 7,694,499 B2
(45) Date of Patent: Apr. 13, 2010

(54) EQUIPMENT AND PROCESS FOR CONTINUOUSLY MAKING STACK PACKAGES OF TILES OR THE LIKE

(75) Inventors: Aris Ballestrazzi, Savignano sul Panaro (IT); Lamberto Tassi, Savignano sul Panaro (IT)

(73) Assignee: SITMA S.p.A., Spilamberto (Modena) (IT)

( * ) Notice: Subject to any disclaimer, the term of this patent is extended or adjusted under 35 U.S.C. 154(b) by 0 days.

(21) Appl. No.: 12/082,905

(22) Filed: Apr. 15, 2008

(65) Prior Publication Data

US 2008/0269035 A1 Oct. 30, 2008

(30) Foreign Application Priority Data

Apr. 30, 2007 (IT) ..... MI2007A0871

(51) Int. Cl.
*B65B 9/06* (2006.01)
*B65B 53/02* (2006.01)

(52) U.S. Cl. ..... 53/545; 53/557; 53/135.3; 53/139.5

(58) Field of Classification Search ..... 53/442, 53/450, 545, 556, 557, 135.2, 135.3, 139.5
See application file for complete search history.

(56) References Cited

U.S. PATENT DOCUMENTS 3,274,746 A * 9/1966 James et al. ..... 53/450
3,958,390 A * 5/1976 Pringle et al. ..... 53/450
4,663,915 A * 5/1987 Van Erden et al. ..... 53/450
4,870,802 A * 10/1989 Cerf ..... 53/557
4,872,302 A * 10/1989 van Eijsden et al. ..... 53/556
4,876,842 A * 10/1989 Ausnit ..... 53/135.3
4,956,963 A * 9/1990 Johnson ..... 53/450
5,155,973 A * 10/1992 Hipko et al. ..... 53/450
5,161,350 A * 11/1992 Nakamura ..... 53/450
5,247,781 A * 9/1993 Runge ..... 53/450
5,285,621 A * 2/1994 Ballestrazzi et al. ..... 53/556
5,966,907 A * 10/1999 Julius ..... 53/450

FOREIGN PATENT DOCUMENTS

EP 1 323 645 A 7/2003
EP 1 350-741 A 10/2003
GB 657 258 A 9/1951
GB 2 122 160 A 1/1984
JP 02 019265 A 1/1990

OTHER PUBLICATIONS

EP Search Report Dated Jul. 29, 2008.

* cited by examiner

*Primary Examiner*—Louis K Huynh
(74) *Attorney, Agent, or Firm*—Hedman & Costigan, P.C.; James V. Costigan

(57) ABSTRACT

Packaging equipment for continuously making packages of stacks of tiles on a working conveyor that feeds the stacks of tiles to be packaged. The equipment has a first element for feeding a plastic film on top of the working conveyor that projects laterally below the stacks of tiles and also has a second element for feeding two laminar elements parallel to each other on top of the plastic film which laterally project below the stacks of tiles. Guiding rods are provided for vertically lifting and upper winding of the projecting portions of the plastic film that is around the stacks of tiles as they advance on the conveyor. Longitudinal welding device and another welding device are provided for welding the plastic film around the stacks of tiles.

9 Claims, 3 Drawing Sheets

Fig.3
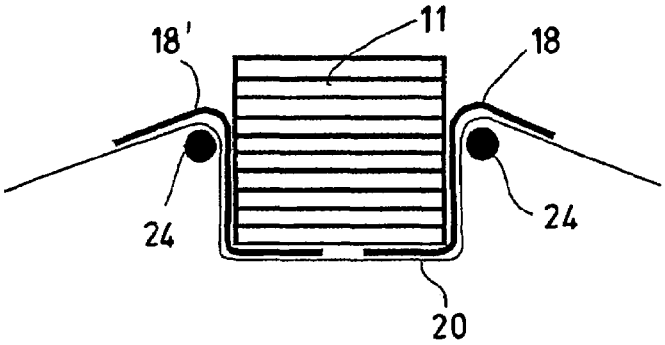
Fig.4
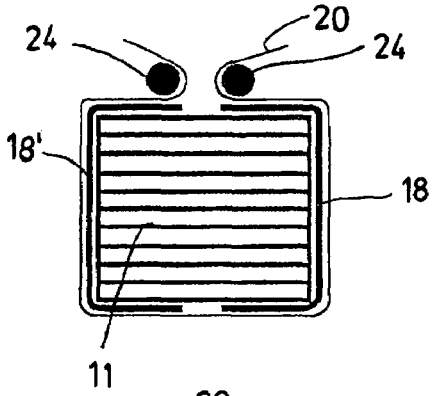
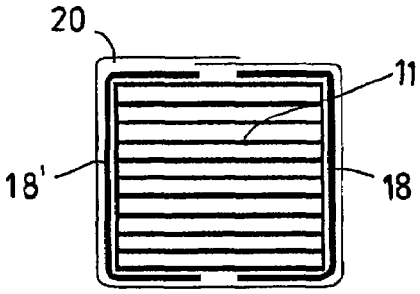
Fig.5
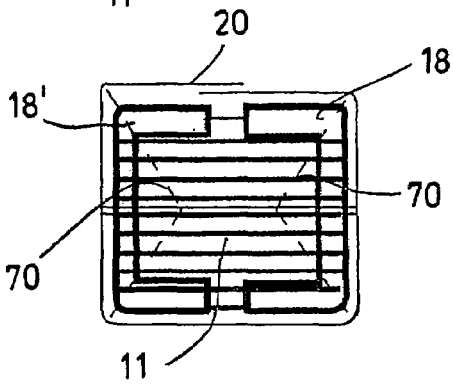
Fig.6

EQUIPMENT AND PROCESS FOR CONTINUOUSLY MAKING STACK PACKAGES OF TILES OR THE LIKE

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1) Field of the Invention

The present invention refers to equipment and a process for continuously making packages of stacks of tiles and the like.

2) Description of Related Art

In the tile field—ceramic tiles, terracotta tiles, etc.—such products are orderly stacked and arranged within cardboard (wrap around technique), possibly providing a binding for the maintenance of the package. This packaging type, aimed for protecting the tiles, nevertheless has several problems, since it can cause difficulties in the detection of the product present in the package, in turn identifiable only by means of the external labelling.

A further serious drawbacks is caused by the fact that the package, if affected by humidity or rain in a possible open air storage in the plant and/or near distributors, tends to be destroyed, no longer carrying out its function, which is also that of containment.

The same must be said for that which takes place in work sites, where the packages arrive before being used in the various rooms covered with tiles.

In addition, the cardboard packaging, if made in the form of previously prepared boxes, leads to the creation of performs in various formats with storage problems of the performs themselves, manufacturing costs of the socket punches for their creation and a certain additional volume to the tile stacks or in any case storage volume of the various perform formats. Naturally, the above must take into account that the packaging must be made automatically in dedicated machines capable of treating both the various perform formats and the stacks of tiles that are not so easily manageable.

The object of the present invention is that of making a device capable of resolving the abovementioned drawbacks of the prior art in an extremely simple, economical and particularly functional manner.

Another object is that of making equipment and a process for continuously making packages of stacks of tiles or the like such to protect the tiles and simultaneously the identification of the type from the outside.

Still another object is that of being able to have equipment and a process for continuously making packages of stacks of tiles or the like that do not deteriorate due to humidity.

BRIEF SUMMARY OF THE INVENTION

These objects according to the present invention are achieved by making equipment and a process for continuously making packages of stacks of tiles or the like as follows: A packaging equipment (10) for continuously making packages (100) of stacks of tiles (11, 11', 11") or the like along a work flow (F) comprising a working conveyor (14) fed from said stacks of tiles (11, 11', 11") and from which said packages (100) exit, a first element (19) for feeding a plastic film (20) on top of said working conveyor (14) projecting laterally below said stacks of tiles (11, 11', 11"), a second element (17, 17') for feeding two laminar elements (18, 18') parallel to each other on top of said plastic film (20), laterally projecting below said stacks of tiles (11, 11', 11"), means (24) for vertically lifting and upper winding of said projecting portions of said plastic film (20) around said stacks of tiles (11, 11', l1")their advancing as they advance along for welding superimposed edges of said wound plastic film for welding said plastic film (20) wound and welded around said stacks of tiles (11, 11', 11") wherein said second element for feeding (17, 17') two laminar elements (18, 18') comprises means (30) for cutting and longitudinally separating said laminar elements (18, 18'), said means (30) for cutting and longitudinally separating said laminar elements (18, 18') also being adapted to feed said laminar elements onto said working conveyor (14) where said laminar elements are separated by a length corresponding to said stacks of tiles (11, 11', 11").

Further characteristics of the invention are made clear in the subsequent claims.

BRIEF DESCRIPTION OF THE SEVERAL VIEWS OF THE DRAWINGS

The characteristics and advantages of equipment and a process for continuously making packages of stacks of tiles or the like according to the present invention will be clearer from the following exemplifying and non-limiting description, referred to the attached schematic drawings in which:

FIGS. 3-6 are views of packages of tile stacks respective along the lines III-III, IV-IV, V-V and VI-VI of FIG. 2;

DETAILED DESCRIPTION OF THE INVENTION

Figure 1:
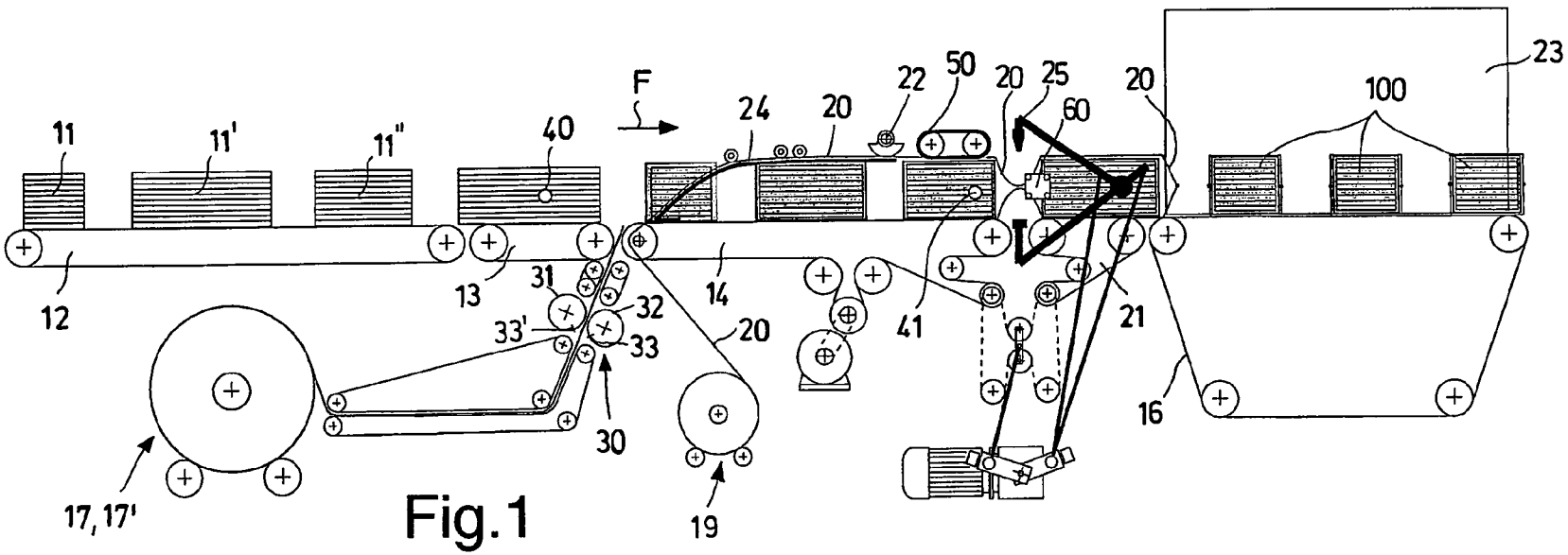
FIG. 1 is a side elevation view of equipment for continuously making packages of stacks of tiles or the like according to the present invention.

With reference to the figures, equipment 10 is shown for continuously making packages 100 of stacks of tiles 11, 11', 11" or the like.

Such equipment 10 for continuously making packages 100 of stacks of tiles 11, 11', 11" or the like along a work flow F comprising a working conveyor 14, fed by stacks of tiles 11, 11', 11" and from which the packages 100 exit, a first group 19 for feeding a plastic film 20 and a second group 17, 17' for feeding two laminar elements 18, 18'.

In particular, according to the invention, the plastic film 20 is continuously fed atop the working conveyor 14 such that it extends laterally below the stack of tiles 11, 11', 11", and the two laminar elements 18, 18' are fed parallel to each other atop the plastic film 20 so that each of them projects laterally below the stack of tiles 11, 11', 11".

The equipment 10 according to the present invention moreover comprises means 24 for the vertical lifting and upper winding of the laterally projecting edges of the plastic film around the stack of tiles 11, 11', 11" during their advancing, a longitudinal welding device 22 of the aforesaid superimposed edges of the plastic film 20 and a front/rear transverse welding device 25 of the plastic film 20 wound and welded around stacks of tiles 11, 11', 11".

Due to such equipment 10, therefore, it is possible to obtain a package 100 of stacks of tiles 11, 11', 11", as seen in FIG. 3.

In fact, the means 24, by vertically lifting the edges of the plastic film 20 projecting laterally from the stacks of tiles 11, 11', 11", proceeds to also lift and simultaneously wind the laminar elements 18, 18', since they too are fed laterally projecting under the stacks of tiles 11, 11', 11".

Figure 2:
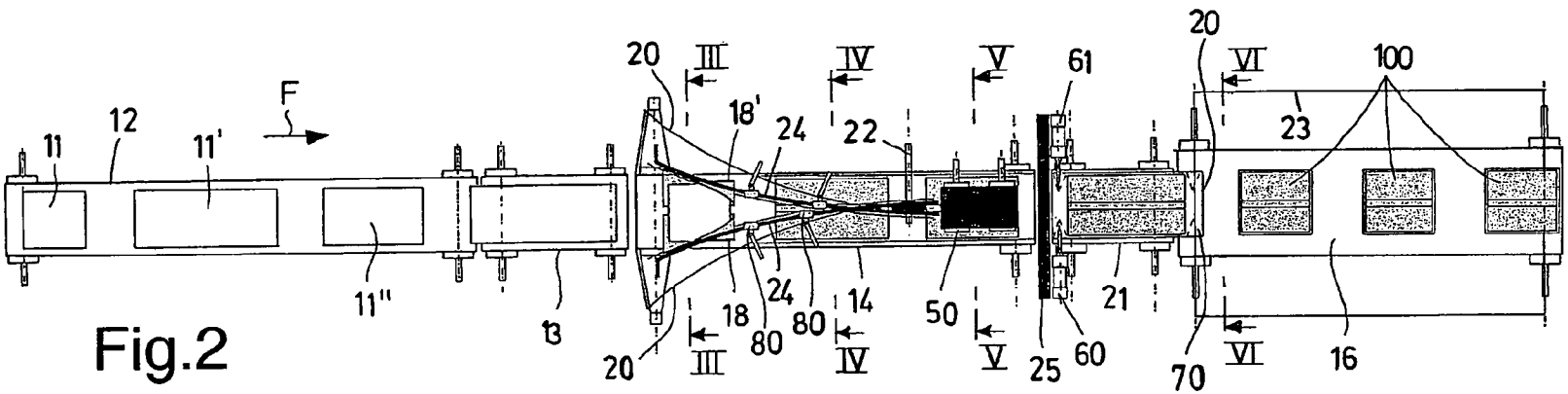
FIG. 2 is a top view of the equipment for continuously making packages of stacks of tiles or the like of FIG. 1 according to the present invention.

In the embodiment shown in FIGS. 1 and 2, such means 24 are two rods that, starting from the conveyor 14, are extended with a first rising section and a second section parallel to the conveyor 14 turned, as is visible in FIG. 2, towards the centre of the conveyor 14 itself.

In such a manner, the plastic film fed on the conveyor 14 being laterally projecting beyond the two rods 24, FIG. 3, during its advancing its laterally projecting edges are lifted, and with them part of the two laminar elements 18, 18' as shown in FIG. 3. Such edges are also wound, so to superimpose them on top of the stacks of tiles 11, 11', 11", FIGS. 4 and 5.

Possibly, in order to favour such vertically lifting process and upper winding process of the laterally projecting edges of the plastic film 20, idle rollers 80 are connected to the aforesaid two rods.

By longitudinally welding, the abovementioned edges of the plastic film 20, lifted and superimposed on top of the stacks of tiles 11, 11', 11", one then proceeds with binding the laminar elements 18, 18' in a laterally winding manner to the same stacks of tiles 11, 11', 11".

Subsequently, the packages 100 are completed by transversely welding, both at the front and back, the portions of the plastic film 20 projecting above and below the tiles 11, 11', 11".

Figures 7, 8:
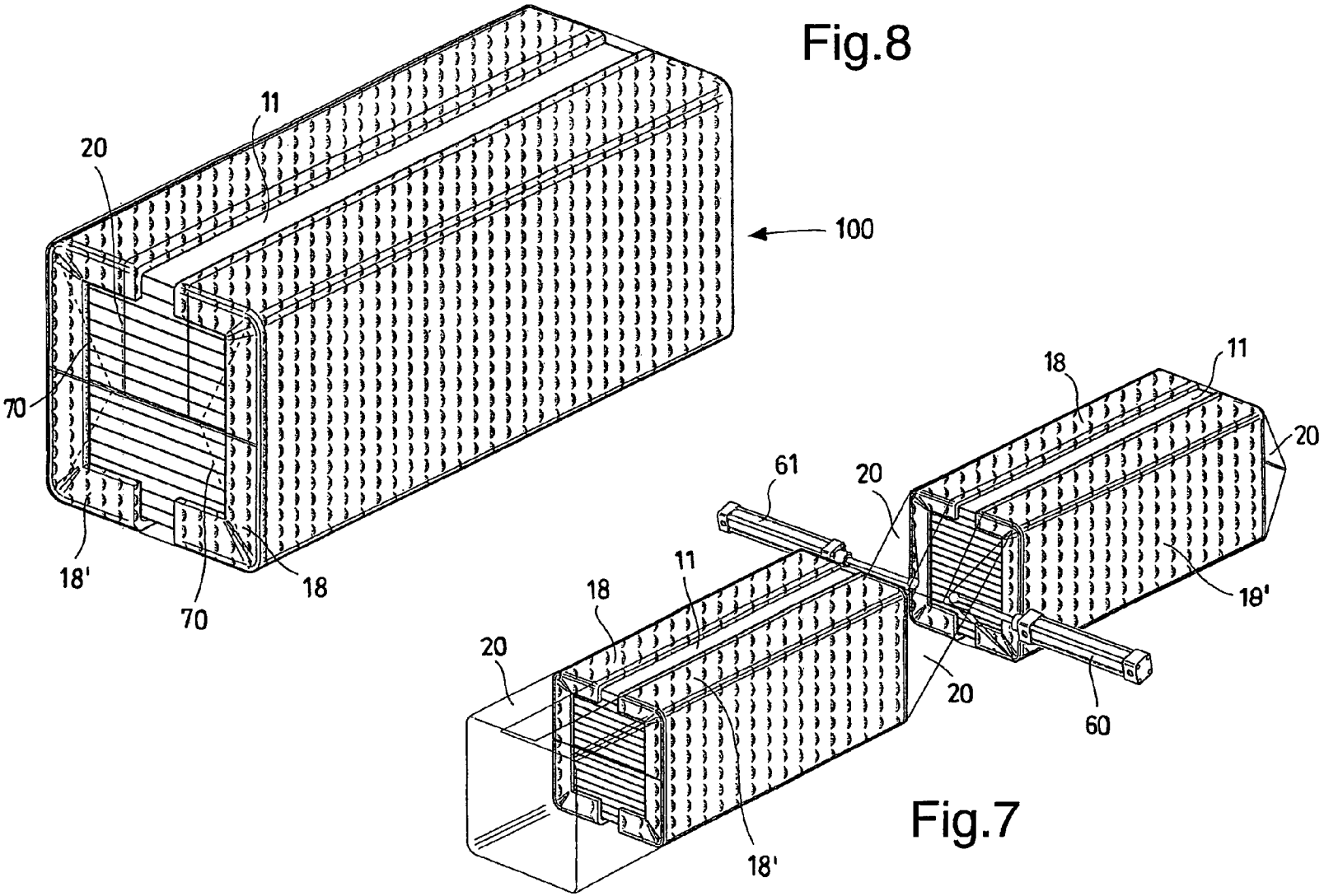
FIG. 7 is an enlarged perspective view of a portion of equipment for continuously making packages of stacks of tiles or the like according to the present invention.
FIG. 8 is a perspective view of a package of stacks of tiles or the like obtainable by means of equipment according to the present invention.

With this last operation, visible in FIG. 1 and which possibly also provides for winding small portions of the two laminar elements 18, 18' projecting at the front and back on the related stack of tiles 11, 11', 11", the plastic film 20 completely winds around the related stack of tiles 11, 11', 11", binding the two laminar elements 18, 18' in the above-described lateral winding position, visible in FIG. 8.

According to the invention, one preferably provides for that the two laminar elements 18, 18' are made of bubble wrap, sponge, cardboard or another soft material and have the object of protecting the critical portions of the tiles 11, 11', 11", such as the edges and sides placed outside the package 100.

The plastic film 20 can be transparent, coloured or moulded and moreover have heat-retractable properties and has the object of closing the package 100, binding the aforesaid laminar elements 18, 18' and permitting the aforesaid identification from the outside of the type of tile contained in the package 100 itself.

The equipment 10 moreover comprises, upstream of the working conveyor 14, a feed conveyor 12, and subsequently an insertion conveyor 13.

In particular, the insertion conveyor 13 can be equipped with a first photocell 40 in order to ensure an insertion of the stacks of tiles 11, 11', 11" in the working conveyor 14 according to a pre-established pitch.

The equipment 10 according to the present invention moreover comprises, downstream of the working conveyor 14, an advancing conveyor 21 and a discharge conveyor 16 for the packages 100.

In particular, the advancing conveyor 21 can also advance in opposite direction to the work flow F.

If a heat-retractable plastic film 20 is used, as indicated above, it is advantageously provide for that the equipment 10 comprises, at the discharge belt 16, a furnace element 23 for the heat shrinking of the plastic film 20 around the related stack of tiles 11, 11', 11".

The equipment 10 can moreover comprise a second photocell 41 placed at the conveyor 14 upstream of the transverse welding device 25.

Such second photocell 41 has the object of signalling to the transverse welding device 25 the beginning and end off the passage of a stack of tiles 11, 11', 11", so to permit the transverse welding device 25 itself to operate in a synchronised manner and to weld at the front and back the plastic film of the related stack of tiles 11, 11', 11" without errors or material wastes.

In order to obtain a package 100 as seen in FIG. 3, the two laminar elements 18, 18' must have a width such that when fed parallel to each other atop the plastic film 20, they project laterally below it for a greater section than the height of said stacks of tiles 11, 11', 11".

In such a manner, one will obtain an optimal winding with the portions of the tiles outside the package protected by the two laminar elements 18, 18' and the central portions visible due to the presence of the single plastic film 20.

In order to feed the two laminar elements 18, 18' according to length dimensions corresponding to the dimensions of the related stack of tiles 11, 11', 11", the second feed group 17, 17' comprises, at the beginning of the conveyor 14, cutting and longitudinal separation means 30 of the laminar elements 18, 18', so that these are fed already separated from each other. Advantageously, moreover, such means 30 can be connected to the first photocell 40 so to synchronise the cutting of the laminar elements 18, 18' with the complete passage of the related stack of tiles 11, 11', 11" on the conveyor 14.

In the embodiment of FIG. 1, the cutting and longitudinal separation means 30 of the laminar elements 18, 18' are at least one roller 31 and at least one related counter-roller 32, each equipped with a cutting element 33, 33' acting on the laminar elements 18, 18' during their passage.

Finally, the equipment 10 can comprise, downstream of the longitudinal welding device 22, a belt device 50, integral with the conveyor 14 and adjustable in height, acting on the upper part of the stacks of tiles 11, 11', 11" in order to flatten the plastic film 20, wound and longitudinally welded on its upper part, and downstream of the transverse welding device 25, means 60, 61 for bending towards the interior of the working conveyor 14 portions of welded plastic film 20 projecting in front and back the stacks of tiles 11, 11', 11".

According to the embodiment, shown in FIGS. 2 and 7, the means 60 and 61 are two piston elements 60, 61, or actuators in general, movable orthogonally to the flow F in order to bend the aforementioned portions of the welded plastic film 20 projecting in front and behind the stacks of tiles 11, 11', 11". If such means 60, 61 are used, the conveyor 21 is made to slow down, or its advancing direction is even reversed.

In FIG. 2, the means are also shown, that can be of any type, for the synchronisation of such conveyor 21, in order to slightly loosen the wound plastic film 20 on the front part and/or back part, in order to permit the aforesaid means 60, 61 to bend towards the inside of the conveyor 14 the loosened portions, projecting frontward and/or backwards.

In such a manner, i.e. by bending towards the interior, as shown with the dashed line 70 in FIGS. 6 and 8, such portions of the plastic film 20 projecting in front of and behind the stacks of tiles 11, 11', 11", an optimal winding of the same is achieved during the related heat shrinking, in the absence of projecting plastic portions.

The functioning of the device, object of the finding, is therefore very easy to understand.

The equipment 10 continuously makes packages 100 of stacks of tiles 11, 11', 11" by means of the following steps:

feeding, on a working conveyor 14, the stacks of tiles 11, 11', 11";

feeding, on the working conveyor 14 under the stacks of tiles 11, 11', 11", a plastic film 20 laterally projecting from the stacks of tiles 11, 11', 11";

feeding, on said working conveyor 14, on top of said plastic film 20 under the stacks of tiles 11, 11', 11", two laminar elements 18, 18' laterally projecting from the stacks of tiles 11, 11', 11";

laterally lifting and winding around said stack of tiles 11, 11', 11" the laterally projecting edges of the plastic film 20;

longitudinally welding the aforesaid superimposed edges of the plastic film 20 around the stacks of tiles 11, 11', 11";

transversely welding the plastic film 20 on the front part and back part of the stacks of tiles 11, 11', 11".

In addition, it can be provided for that the equipment 10 also makes the steps of flattening the plastic film 20 on its upper part, such plastic film 20 being welded on its upper part and wound around the stacks of tiles 11, 11', 11"; and bending, towards the interior of working conveyor 14, the portions projecting from the front and back of the stacks of tiles 11, 11', 11" of the transversely welded plastic film 20.

Finally, it can be provided that the equipment 10 also achieves the final step of feeding the packages 100 into a furnace 23 for thermally shrinking the plastic film 20 wound and welded around the stacks of tiles 11, 11', 11".

In such a manner, the equipment 10 achieves packages 100 of stacks of tiles 11, 11', 11" externally provided with a plastic film 20 that completely wraps them and internally with two laminar elements 18, 18', generically bubble wrap, that protect the tiles 11, 11', 11" by completely wrapping them on their side and partially wrapping them on their top and bottom.

Such package 100 therefore prevents the problems connected with the currently known tile packages.

In particular, the package 100 prevents possible damage of the tiles 11, 11', 11" both arising from impact and from deterioration of the packages themselves, in which, unlike the known packages, moisture does not penetrate.

Simultaneously, the package 100 permits advantageously identifying the type of tile 11, 11', 11" contained in the package 100 itself.

It has thus been seen that equipment and a process for continuously making packages of stacks or the like according to the present invention achieves the above-mentioned objects.

The equipment and a process for continuously making packages of stacks or the like of the present invention thus conceived is susceptible to numerous modifications and variants, all part of the same inventive concept; moreover, all details can be substituted by technically equivalent elements. In practice, the materials used, as well as their dimensions, can be of any type according to technical needs.

The invention claimed is:

1. Equipment (10) for continuously making packages (100) of stacks of tiles (11, 11', 11") along a work flow (F) comprising a working conveyor (14), fed from said stacks of tiles (11, 11', 11") and from which said packages (100) exit, a first element (19) for feeding a plastic film (20) on top of said working conveyor (14) projecting laterally below said stacks of tiles (11, 11', 11"), a second element (17, 17') for feeding two laminar elements (18, 18') parallel to each other on top of said plastic film (20), laterally projecting below said stacks of tiles (11, 11', 11"), means (24) for vertically lifting and upper winding of said projecting portions of said plastic film (20) around said stacks of tiles (11, 11', 11") as they advance along said working conveyor, a longitudinal welding device (22) for welding superimposed edges of said wound plastic film (20) and a front/rear transverse welding device (25) for welding said plastic film (20) wound and welded around said stacks of tiles (11, 11', 11") wherein said second element for feeding (17, 17') two laminar elements (18, 18') comprises means (30) for cutting and longitudinally separating said laminar elements (18, 18'), said means (30) for cutting and longitudinally separating said laminar elements (18, 18') also being adapted to feed said laminar elements onto said working conveyor (14) where said laminar elements are separated by a length corresponding to said stacks of tiles (11, 11', 11").

2. Equipment (10) according to claim 1, characterised in that it moreover comprises a belt device (50) downstream of said longitudinal welding device (22) placed on top of said stacks of tiles (11, 11', 11") in order to flatten said plastic film (20) wound and longitudinally welded on its upper part.

3. Equipment (10) according to claim 1, characterised in that it moreover comprises, downstream of said transverse welding device (25), means (60, 61) for bending, towards the interior of said working conveyor (14), portions projecting at the front and back of said stacks of tiles (11, 11', 11") of said longitudinally and transversely welded plastic film (20).

4. Equipment (10) according to claim 1, characterised in that it moreover comprises, upstream of said working conveyor (14), a feed conveyor (12) and subsequently an insertion conveyor (13) equipped with a first photocell (40) for inserting said stacks of tiles (11, 11', 11") in said working conveyor (14) according to a pre-established pitch.

5. Equipment (10) according to claim 4, characterised in that it comprises a second photocell (41) placed at said working conveyor (14) upstream of said transverse welding device (25) for its activation.

6. Equipment (10) according to claim 1, characterised in that it moreover comprises, downstream of said working conveyor (14), an advancing conveyor (21) and a discharge conveyor (16) of said packages (100).

7. Equipment (10) according to claim 5, characterised in that the advancing conveyor (21) can slow its advancing speed or reverse it with respect to said flow (F).

8. Equipment (10) according to claim 7, characterised in that at said discharge conveyor (16) it comprises a furnace element (23) for heat shrinking of said plastic film (20) of said package (100) wound and welded around said stacks of tiles (11, 11', 11").

9. Equipment (10) according to claim 1, characterised in that said means (30) for cutting and longitudinally separating said laminar elements (18, 18') are at least one roller (31) and at least one related counter-roller (32), each equipped with at least one cutting element (33, 33') for said laminar elements (18, 18') during their passage between said at least one roller (31) and said at least one related counter-roller (32).

* * * * *